US008015927B1

(12) United States Patent
Helline

(10) Patent No.: US 8,015,927 B1
(45) Date of Patent: Sep. 13, 2011

(54) CLEANING TRAY

(76) Inventor: Jeffrey J Helline, Port Clinton, OH (US)

( * ) Notice: Subject to any disclaimer, the term of this patent is extended or adjusted under 35 U.S.C. 154(b) by 538 days.

(21) Appl. No.: 12/257,087

(22) Filed: Oct. 23, 2008

Related U.S. Application Data

(60) Provisional application No. 61/076,168, filed on Jun. 27, 2008.

(51) Int. Cl.
*A47B 37/00* (2006.01)

(52) U.S. Cl. ..... 108/26; 108/97; 248/231.71

(58) Field of Classification Search ..... 108/97, 108/98, 25, 26, 24, 28; 248/230.6, 231.71, 248/318; 297/188.2, 153; 220/908.3, 910; 193/2 A; 43/55; 452/194; 206/315.11; 15/257.9; 269/15; 312/280–282; 211/90.01
See application file for complete search history.

(56) References Cited

U.S. PATENT DOCUMENTS

| | | | | | |
|---|---|---|---|---|---|
| 1,006,994 | A | * | 10/1911 | Barnes | 248/231.71 |
| 2,090,176 | A | * | 8/1937 | Besancon | 248/231.81 |
| 2,329,660 | A | * | 9/1943 | Smith | 220/23.83 |
| 2,920,757 | A | * | 1/1960 | Garman | 206/45.21 |
| 3,107,636 | A | * | 10/1963 | Knight | 108/102 |
| 3,325,038 | A | * | 6/1967 | Ferney | 52/11 |
| 3,744,645 | A | * | 7/1973 | Hochman | 211/86.01 |
| 3,949,880 | A | * | 4/1976 | Fortunato | 211/119.003 |
| D356,468 | S | * | 3/1995 | Beck et al. | D6/406.5 |
| 5,474,494 | A | * | 12/1995 | Sims | 452/194 |
| 6,026,972 | A | * | 2/2000 | Makowski | 220/495.08 |
| 6,371,470 | B1 | * | 4/2002 | Ward | 269/289 R |
| 6,880,470 | B2 | | 4/2005 | Sidor et al. | |

* cited by examiner

*Primary Examiner* — Janet M Wilkens
(74) *Attorney, Agent, or Firm* — Crossley Patent Law; Mark A. Crossley

(57) ABSTRACT

A cleaning tray for removably engaging a table outer edge which has a parallelepiped main body having two internal wedges therein, a removable receptacle for receiving trash centered in the main body, and a rectangular compartment for holding cleaning supplies, the compartment attached to a rear side of the main body.

9 Claims, 5 Drawing Sheets

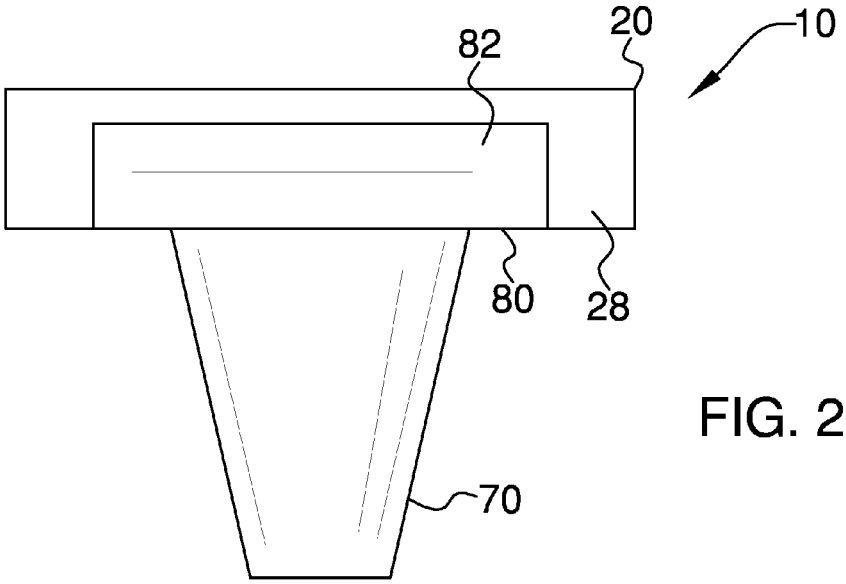
FIG. 2
FIG. 3
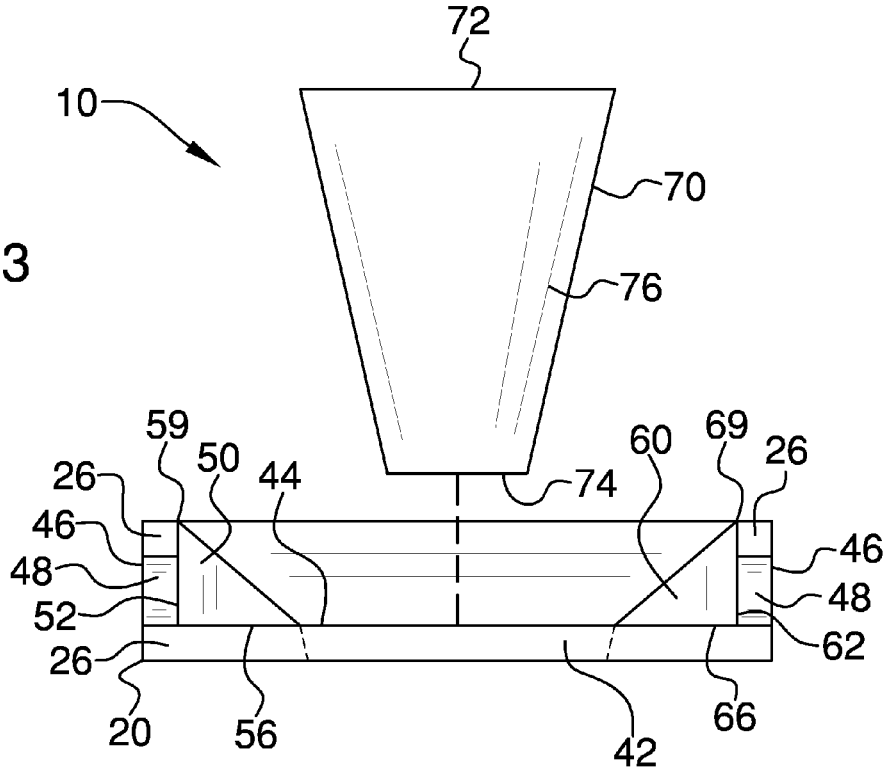

CLEANING TRAY

CROSS-REFERENCE TO RELATED APPLICATIONS

US Provisional Application No. 61,076,168 filed Jun. 27, 2008

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

1. Field of the Invention

The present invention relates to a cleaning tray which is a table attachment providing a removable depository for refuse and litter from an eating area, a built in storage compartment for table cleaning supplies, and a hook for hanging a waste bag.

2. Description of the Prior Art

Various cleaning trays are provided in the prior art. For example, one patent teaches a waste disposal apparatus with a retractable drop chute for delivering waste to a waste container which is movably connected beneath a surface covering the entire waste container. Another patent teaches a tray having a refuse receptacle attachable to a chair. Still another patent provides a debris receptacle attachable to a cutting board. Even another patent teaches a work surface device aiding in disposal of items, while another patent teaches a combination of a table for a receptacle and a waste container. Still even another patent teaches a table and trash disposal combined device.

While the above-described devices fulfill their respective and particular objects and requirements, they do not describe a cleaning tray that provides for the advantages of the present invention; therefore, a need exists for an improved cleaning tray that is designed to hook onto a table, featuring a built-in storage compartment for cleaning supplies, the tray having inwardly sloping wedges to assist in wiping crumbs and other waste into a trash receptacle in the center of the tray, and a hook upon which a removable waste bag is carried.

In this respect, the present invention substantially departs from the conventional concepts and designs of the prior art.

SUMMARY OF THE INVENTION

In view of the foregoing known types of cleaning trays now present in the prior art, the present invention provides a novel cleaning tray. As such, the general purpose of the present invention, which will be described subsequently in greater detail, is to provide a new and improved cleaning tray which has all the advantages of the prior art mentioned heretofore and many novel features that result in a cleaning tray which is not anticipated, rendered obvious, suggested, or even implied by the prior art, either alone or in any combination thereof.

To attain this, the present cleaning tray essentially provides a primary body having two arms forming a C-shape to hook the tray onto a table, a built-in storage compartment for cleaning supplies, the tray having inwardly sloping wedges to assist in wiping crumbs and guiding other waste into a trash receptacle in the center of the tray, and a hook upon which a removable waste bag is carried.

The present cleaning tray may be used in restaurants, lounges, cafeterias and the like to assist individuals, including waitresses, servers, busboys, and caterers, in cleaning tables and disposing of trash left on and around tables. The present tray may be used by anyone who needs to clean up a table and the surrounding area. Use of the present tray further assists in keeping floors and tables, and even booths and chairs, clean and sanitary which, in turn, reduces the potential for insect and rodent invasion. By keeping crumbs from falling on the floor during table cleaning, the tray also helps to keep the crumbs from being stepped on and embedded into the floor. The present tray is a timesaving tool in that several tables may be sequentially cleaned without having to return to a receptacle to empty both liquid and solid debris, such as empty wrappers and bags, paper cups, condiment packets, stirrers, sugar and creamer packets, food crumbs, and the like, as each table is cleaned, while simultaneously providing ready access to cleaning supplies, such as spray cleaners and cloths, without having to grab up the cleaning supplies in one's hands and/or underneath one's arms, which is often a difficult balancing act to achieve. Thus, the present tray also makes the atmosphere more aesthetically pleasing and clean for patrons. The present tray is easy to use, simple to clean, convenient, effective, durable, timesaving and reasonably priced.

The present cleaning tray has a smooth surface for easier cleaning of the tray after use and is lightweight enough to be easily carried from table to table while being durable enough to support cleaning supplies and several tables' worth of trash. The tray may be made of injection molded plastic material, such as polypropylene or the like, or other suitable materials which allow the tray to serve its objects and purposes.

The present cleaning tray may be produced in a wide variety of colors. The colors used to produce the cleaning tray may be colors identified with a particular business. Further, the tray may be embellished with various names and logos of businesses such as commercial eating and drinking establishments.

There has thus been outlined, rather broadly, the more important features of the invention in order that the detailed description thereof that follows may be better understood and in order that the present contribution to the art may be better appreciated.

It is therefore an object of the present invention to provide a new and improved cleaning tray that has all of the advantages of the prior art cleaning trays and none of the disadvantages.

Another object of the present cleaning tray is to provide a new and improved cleaning tray that may be easily and efficiently manufactured and marketed.

Still another object of the present cleaning tray is to be removably attachable to a table.

Even another object of the present cleaning tray is to provide a portable waste receptacle while also providing a storage compartment for table cleaning supplies.

An even further object of the present invention is to provide a new and improved cleaning tray that has a low cost of manufacture with regard to both materials and labor, and which accordingly is then susceptible of low prices of sale to the consuming public, thereby making such cleaning tray economically available to the buying public.

Still another object of the present cleaning tray is to provide internal wedges that assist in wiping crumbs and guiding other waste into a trash receptacle in the center of the tray Still another object of the present tray is to provide a cleaning tray that is timesaving for cleaning personnel that clean tables.

Even still another object of the present cleaning tray is to provide a cleaning tray that is easily lifted and carried from table to table while being durable enough to support cleaning supplies and several tables' worth of trash.

Thus has been broadly outlined the more important features of the present cleaning tray so that the detailed description thereof that follows may be better understood and in order that the present contribution to the art may be better appreciated.

Numerous objects, features and advantages of the cleaning tray will be readily apparent to those of ordinary skill in the art upon reading the following detailed description of presently preferred, but nonetheless illustrative, embodiments of the cleaning tray when taken in conjunction with the accompanying drawings. In this respect, before explaining the current embodiments of the cleaning tray in detail, it is to be understood that the invention is not limited in its application to the details of construction and arrangements of the components set forth in the following description or illustration. The invention is capable of other embodiments and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the cleaning tray. It is therefore important that the claims be regarded as including such equivalent constructions insofar as they do not depart from the spirit and scope of the present invention.

These together with additional objects of the cleaning tray, along with various novel features that characterize the invention are particularly pointed out in the claims forming a part of this disclosure. For better understanding of the cleaning tray, its operating advantages and specific objects attained by its uses, refer to the accompanying drawings and description.

BRIEF DESCRIPTION OF THE DRAWINGS

Figures

FIG. 2 is a rear elevation view.

FIG. 3 is an exploded front elevation view illustrating a trash receptacle removed.

DETAILED DESCRIPTION OF THE PREFERRED EMBODIMENT

Figure 1:
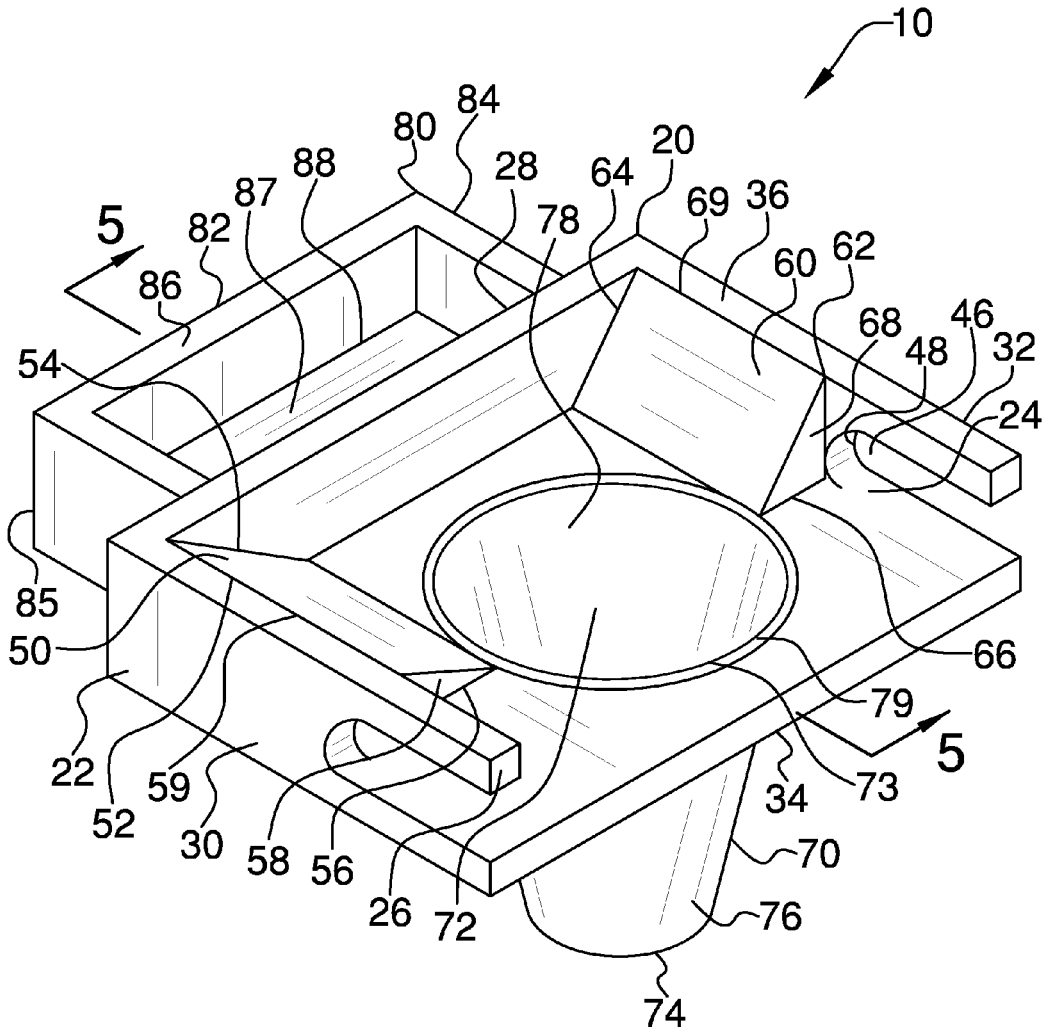
FIG. 1 is a front perspective view.
Figure 4:
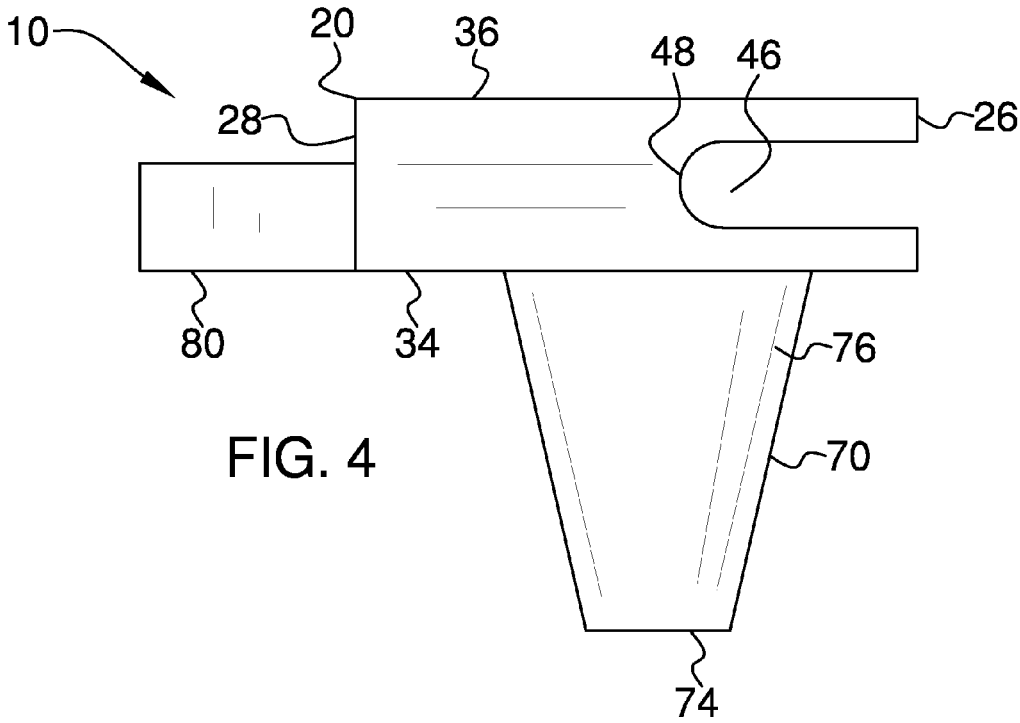
FIG. 4 is a right side elevation view, the opposing side being a mirror image of the shown.
Figure 5:
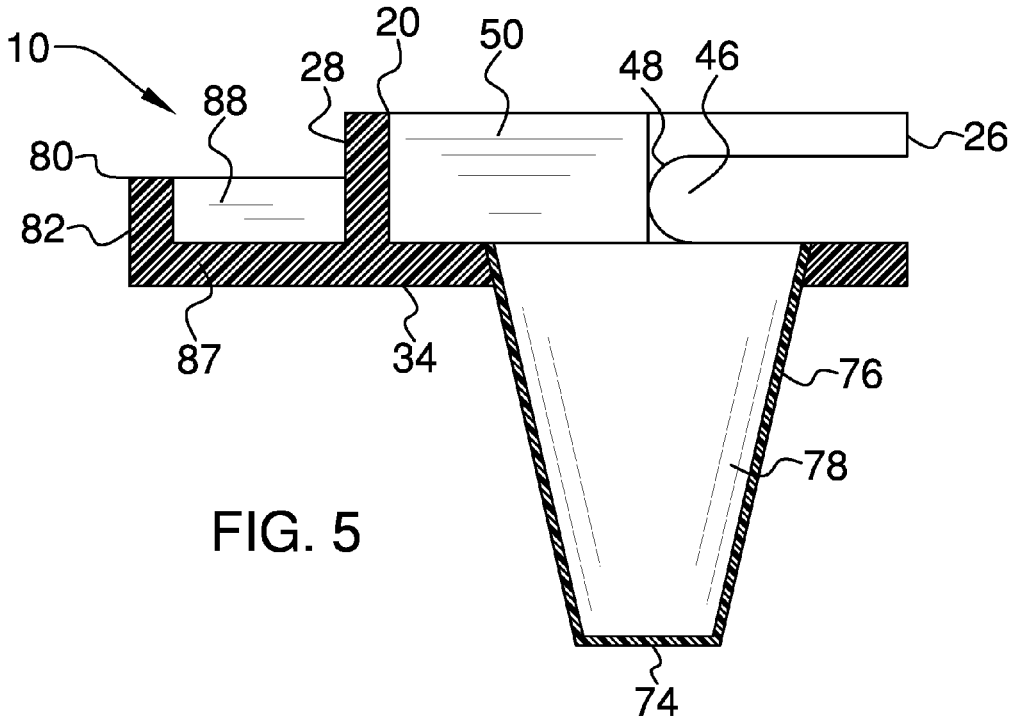
FIG. 5 is a cross-section view taken along line 5-5 of FIG. 1.
Figure 6:
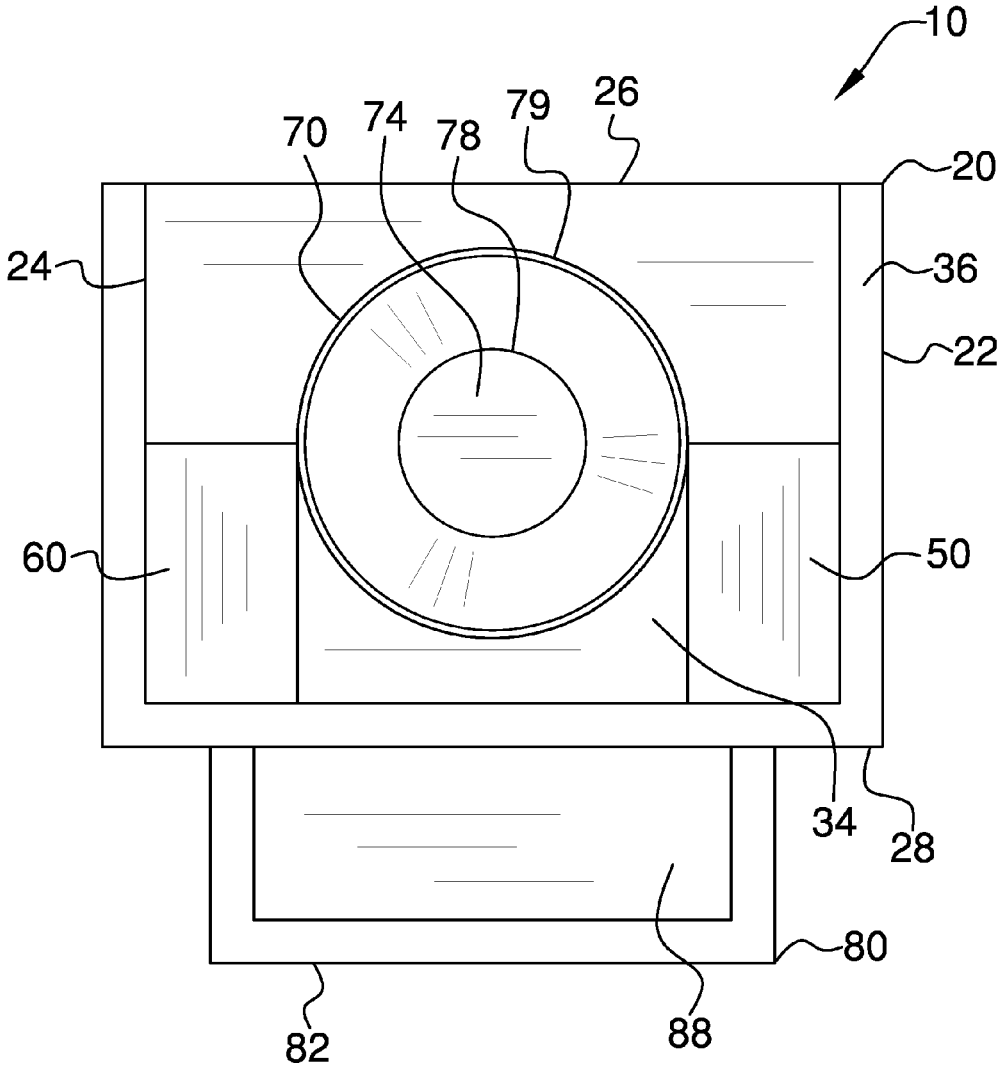
FIG. 6 is a top plan view.
Figure 7:
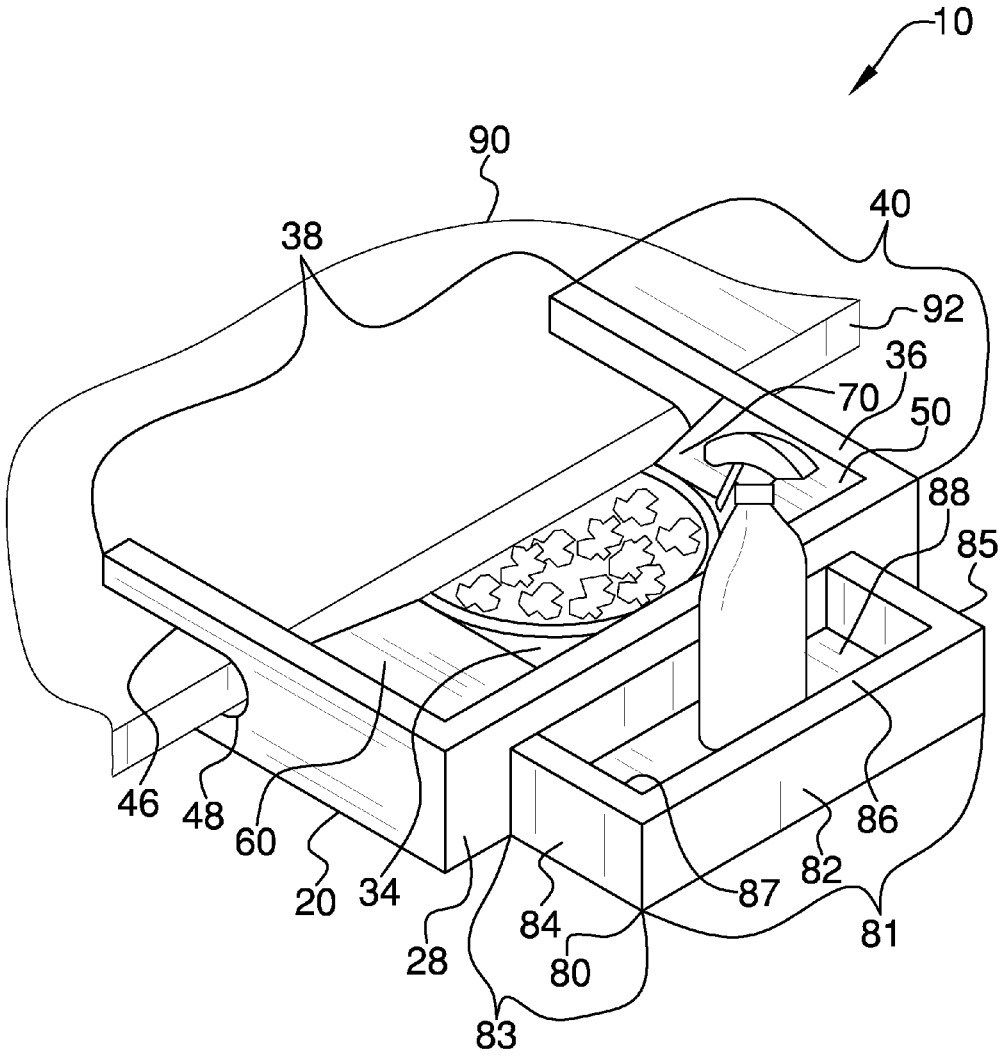
FIG. 7 is an in-use rear perspective view of the present device attached to a table.

With reference now to the drawings, and in particular to FIGS. 1 through 7 thereof, a preferred embodiment of the present cleaning tray employing the principles and concepts of the present cleaning tray and generally designated by the reference numeral 10 will be described.

Referring to FIGS. 1 through 7, the present cleaning tray 10 removably engages a table 90 having an outer edge 92. The cleaning tray 10 provides a main body 20, a first wedge 50 and a second wedge 60 inside the main body 20, a receptacle 70 for trash disposal centered in the main body 20, and a storage compartment 80 permanently attached to the main body 20.

The parallelepiped main body 20 has an exterior portion 22, an interior portion 24, a front side 26, a rear side 28, a left side 30, a right side 32, a bottom side 34, a top edge 36, a first width 38, a first length 40, and an aperture 42 having a first perimeter 44. The aperture 42 is centered in the bottom side 34 of the interior portion 24. The left side 30 and right side 32 each have an elongated C-shaped opening 46 continuously extending rearwardly from the front side 26. The opening 46 is about one-half the length of the main body 20. The opening 46 has a rear apex 48. The opening 46 removably slideably engages a table 90 outer edge 92, which allows the present cleaning tray to removably engage a table 90 outer edge 92. The opening 46 forms arm-like extensions that hook onto the table 90 outer edge 92.

The first wedge 50 has a first interior edge 52 permanently attached to the interior portion 24 on the left side 30, a first proximal edge 54 permanently attached to the interior portion 24 on the rear side 28, a first bottom edge 56 permanently attached to the interior portion 24 on the bottom side 34, a first distal edge 58 adjacent to the rear apex 48 of the C-shaped opening 46 and a first upper apex 59 adjacent to the main body 20 top edge 36. The second wedge 60 has a second interior edge 62 permanently attached to the interior portion 24 on the right side 32, a second proximal edge 64 permanently attached to the interior portion 24 on the rear side 28, a second bottom edge 66 permanently attached to the interior portion 24 on the bottom side 34, a second distal edge 68 adjacent to the rear apex 48 of the C-shaped opening 46, and a second upper apex 69 adjacent to the main body 20 top edge 36. Each wedge 50, 60 may have about a 45-degree slope as illustrated to assist in wiping crumbs and guiding other waste into the receptacle 70 in the center of the bottom side 34. The slope may vary but only insofar as the slope accomplishes the purpose of assisting in wiping crumbs and guiding other waste into the receptacle 70.

A conical receptacle 70 removably engages the aperture 42. The receptacle 70 has an open top end 72 having a second perimeter 73, a closed bottom end 74, a continuous first wall 76 between the top end 72 and bottom end 74, an interior cavity 78 defined by the top end 72, the bottom end 74, and the first wall 76, and a continuous lip 79. The lip 79 extends outwardly from the top end 72 second perimeter 73 and removably engages the aperture 42 first perimeter 44 adjacent the bottom side 34.

The parallelepiped compartment 80 extends rearwardly from the main body 20 rear side 28. The compartment 80 has a rear edge 82, a right edge 84, a left edge 85, an upper edge 86, a bottom wall 87, and a rectangular internal cavity 88 defined by the main body 20 rear side 32, the compartment 80 rear edge 82, the right edge 84, the let edge 85, the upper edge 86 and the bottom wall 87.

In the preferred embodiment, the main body 20 of the present cleaning tray 10 has a first length 40 of about 13 inches long, a first width 38 in a range of about 18 to 22 inches wide, an external height of about 4 inches, and inwardly sloping first and second wedges 50, 60 each having a length of about 5 inches. Also in the preferred embodiment, the length from the front side 26 of the main body 20 to the rear apex 48 of the opening 46 is about 4½ inches. The opening 46 is about 2 inches in height in the preferred embodiment. The conical receptacle 70, in the preferred embodiment, has a 4½-inch radius at the open top end 72 and a height of about 11 inches. Also, in the preferred embodiment, the storage compartment has a second width 81 of about 13 inches, a second length 83 of about 4½ inches and an internal depth of about 4 inches. Thus, the compartment has a second width about ⅔ as wide as a main body first width and a second length about ⅓ as long as a main body first length in the preferred embodiment. While the dimensions may vary in other embodiments, the dimensions must permit the present cleaning tray to attach and balance properly to a table while supporting trash disposed of therein and also supporting cleaning supplies stored in the cleaning compartment and to be easily lifted and carried. The present cleaning tray 10 is formed of a smooth, lightweight, durable material, including injection molded plastic, polypropelene, and other materials having similar properties.

Use:

In use, it can now be understood that the cleaning tray 10 provides a useful item for assisting in the clean up of tables. To use the present cleaning tray 10, a user simply places cleaning supplies, including cleaners and rags or sponges, in the storage compartment 80 and removably attaches the tray 10 to the outer edge 92 of a table 90 by sliding each opening 46 on the left side 20 and right side 32 over the outer edge 92 of the table 90. The user may dispose of trash left on the table or nearby by placing the trash in the receptacle 70.

While a preferred embodiment of the cleaning tray 10 has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A cleaning tray for removably engaging a table having an outer edge, the cleaning tray comprising:

a parallelepiped main body having an exterior portion, an interior portion, a front side, a rear side, a left side, a right side, a bottom side, a top edge, a first width, a first length, an aperture having a first perimeter, the aperture centered in the bottom side of the interior portion, the left side and right side each having an elongated C-shaped opening continuously extending rearwardly from the front side about one-half the length of the main body, the C-shaped opening having a rear apex;

a first wedge having a first interior edge permanently attached to the interior portion on the left side, a first proximal edge permanently attached to the interior portion on the rear side, a first bottom edge permanently attached to the interior portion on the bottom side, a first distal edge adjacent to the rear apex of the C-shaped opening, and a first upper apex adjacent to the main body top edge;

a second wedge having a second interior edge permanently attached to the interior portion on the right side, a second proximal edge permanently attached to the interior portion on the rear side, a second bottom edge permanently attached to the interior portion on the bottom side, a second distal edge adjacent to the rear apex of the C-shaped opening, and a second upper apex adjacent to the main body top edge;

a conical receptacle removably engaging the aperture, the receptacle having an open top end having a second perimeter, a closed bottom end, a continuous first wall between the top end and bottom end, an interior cavity defined by the top end, the bottom end and the first wall, and a continuous lip extending outwardly from the top end second perimeter end and removably engaging the aperture first perimeter adjacent the bottom side; and a parallelepiped compartment extending rearwardly from the main body rear side, the compartment having a rear edge, a right edge, a left edge, an upper edge, a bottom wall, and a rectangular internal cavity defined by the main body rear side, the rear edge, the right edge, the left edge, the upper edge and the bottom wall.

2. The cleaning tray of claim 1 wherein the opening removably slideably engages a table outer edge, the opening having a length from the front side of the main body to the rear apex of the opening and having a height.

3. The cleaning tray of claim 2 wherein the length from the front side of the main body to the rear apex of the opening is about 4½ inches and the opening has a height of about 2 inches.

4. The cleaning tray of claim 1 wherein the first wedge and second wedge each have about a 45-degree slope.

5. The cleaning tray of claim 1 wherein the cleaning tray is formed of a smooth, lightweight, durable material.

6. A cleaning tray for removably engaging a table outer edge, the cleaning tray comprising:

a parallelepiped main body having an exterior portion, an interior portion, a front side, a rear side, a left side, a right side, a bottom side, a top edge, a first width, a first length, an aperture having a first perimeter, the aperture centered in the bottom side of the interior portion, the left side and right side each having an elongated C-shaped opening continuously extending rearwardly from the front side about one-half the length of the main body, the C-shaped opening having a rear apex;

a first wedge having a first interior edge permanently attached to the interior portion on the left side, a first proximal edge permanently attached to the interior portion on the rear side, a first bottom edge permanently attached to the interior portion on the bottom side, a first distal edge adjacent to the rear apex of the C-shaped opening, and a first upper apex adjacent to the main body top edge;

a second wedge having a second interior edge permanently attached to the interior portion on the right side, a second proximal edge permanently attached to the interior portion on the rear side, a second bottom edge permanently attached to the interior portion on the bottom side, a second distal edge adjacent to the rear apex of the C-shaped opening, and a second upper apex adjacent to the main body top edge;

a conical receptacle removably engaging the aperture, the receptacle having an open top end having a second perimeter, a closed bottom end, a continuous first wall between the top end and bottom end, an interior cavity defined by the top end, the bottom end and the first wall, and a continuous lip extending outwardly from the top end second perimeter end and removably engaging the aperture first perimeter adjacent the bottom side; and a parallelepiped compartment extending rearwardly from the main body rear side, the compartment having a rear edge, a right edge, a left edge, an upper edge, a bottom wall, and a rectangular internal cavity defined by the main body rear side, the rear edge, the right edge, the left edge, the upper edge and the bottom wall, the compartment further having a second width about ⅔ as wide as a main body first width and a second length about ⅓ as long as a main body first length;

the first wedge and the second wedge each further having about a 45-degree slope.

7. The cleaning tray of claim 6 wherein the opening removably slideably engages a table outer edge, the opening having a length from the front side of the main body to the rear apex of the opening of about 4½ inches and having a height of about 2 inches;

the receptacle has a length of about 11 inches; and the receptacle top end has about a 4½-inch radius.

8. The cleaning tray of claim 6 wherein the cleaning tray is formed of a smooth, lightweight, durable material.

9. The cleaning tray of claim 8 wherein the material is injection molded plastic.

* * * * *